US010023271B2

(12) United States Patent
Menna

(10) Patent No.: US 10,023,271 B2
(45) Date of Patent: Jul. 17, 2018

(54) RAPID WATER AMBULANCE FOR TRANSPORT OF THE INJURED, PATIENTS AND THE LIKE

(71) Applicant: STEM S.R.L., Medesano (IT)

(72) Inventor: Ezio Menna, Medesano (IT)

(73) Assignee: STEM S.R.L., Medesano (PR) (IT)

( * ) Notice: Subject to any disclaimer, the term of this patent is extended or adjusted under 35 U.S.C. 154(b) by 0 days.

(21) Appl. No.: 15/440,234

(22) Filed: Feb. 23, 2017

(65) Prior Publication Data

US 2017/0240252 A1 Aug. 24, 2017

(30) Foreign Application Priority Data

Feb. 23, 2016 (IT) ..... 102016000018561

(51) Int. Cl.

| | |
|---|---|
| ***B63B 29/02*** | (2006.01) |
| ***B63B 29/04*** | (2006.01) |
| ***B63B 17/00*** | (2006.01) |
| ***B63B 35/00*** | (2006.01) |

(52) U.S. Cl.

CPC ..... *B63B 29/02* (2013.01); *B63B 17/00* (2013.01); *B63B 29/04* (2013.01); *B63B 35/00* (2013.01)

(58) Field of Classification Search

CPC ..... B63B 29/02; B63B 29/04; B63B 17/00; B63B 35/00

USPC ..... 114/343, 363; 5/9.1, 625, 626, 627

See application file for complete search history.

(56) References Cited

U.S. PATENT DOCUMENTS

| | | | | |
|---|---|---|---|---|
| 3,606,619 A | | 9/1971 | Stollenwerk | |
| 4,466,145 A | | 8/1984 | Jones et al. | |
| 5,813,629 A | * | 9/1998 | Cabrera | B64D 9/00 5/626 |
| 5,860,176 A | * | 1/1999 | Norberg | A61G 1/00 5/625 |

FOREIGN PATENT DOCUMENTS

| | | |
|---|---|---|
| EP | 0278547 A2 | 8/1988 |
| GB | 120434 A | 11/1918 |
| GB | 726719 A | 3/1955 |

* cited by examiner

*Primary Examiner* — Lars A Olson

(74) *Attorney, Agent, or Firm* — Browdy and Neimark, P.L.L.C.

(57) ABSTRACT

A rapid water ambulance for transport of patients, comprising a sick bay solidly constrained to a structure of the water ambulance and support apparatus (10) for a stretcher, the support apparatus (10) comprises: a support column (20), a carriage (30) slidable along the column (20) in the direction of the axis (A) thereof, a support plane (11) for a stretcher, borne projectingly by the carriage (30) and solidly constrained thereto, a damped suspension device (33), constrained to the carriage (30) and to the column (20), which supports the support plane (11) at an operating height, wherein the axis (A) of the support column (20) is inclined with respect to the perpendicular direction to a floor (P) plane of the sick bay and lies in a vertical plane parallel to the motion direction of the water ambulance.

7 Claims, 8 Drawing Sheets

RAPID WATER AMBULANCE FOR TRANSPORT OF THE INJURED, PATIENTS AND THE LIKE

The present invention relates to a rapid water ambulance for transport of the injured, patients and the like.

A preferred application for the invention is for boats having a length of up to 25 meters.

The technical problem addressed is how to absorb and damp impacts to which the boat is subjected when ploughing through waves during navigation, especially if it is moving at relatively high speeds. In fact, during navigation, the boat frequently encounters waves which hinder its progress, and produce, especially if it is travelling at high speed, impacts which reflect on the structure of the boat and all and everything on board; obviously these impacts are endured with difficulty and are damaging for patients and injured parties rested on a support plane of the stretcher located in the sick bay of the boat, especially if the patient is in a critical condition.

The same type of problem is also encountered in road ambulances; in this case too the vehicle is usually subjected to impacts, in a vertical direction, caused by rough road surfaces, and in order to neutralise these impacts as much as possible various types of equipment are known which support the stretcher and are provided with means able to absorb the impacts and damp them.

However these impacts to which the water ambulance is subjected due to the waves it encounters on the water surface are of a different type with respect to road-travelling vehicles, as the waves both cause the boat to make vertical movements between the top and bottom of the wave and vice versa, and form steep masses of water which oppose the advancement of the boat in a horizontal direction, with the result that they subject the boat to impacts having both a vertical and a horizontal component.

Owing to this, the use of apparatus created for road-going ambulances are not satisfactory for use on water ambulances. An aim of the invention is to provide the boat with a support apparatus for the stretcher bearing the patient that is able to absorb and damp impacts to which the boat is subjected when ploughing through waves during navigation, especially if it is moving at relatively high speeds.

This and other aims are attained by the present invention as it is characterised in claim 1.

In fact the plane supporting the stretcher is slidingly mobile along the support column and the movement thereof in a downwards direction is opposed by the damped suspension device which supports the weight of the stretcher and the patient and maintains the support plane at a desired operating height with respect to the floor plane of the sick bay; the suspension device thus absorbs all the impacts in a vertical direction (caused by the vertical jerks of the boat) since the impacts are unloaded onto the support plane, causing sliding thereof along the column in a downwards direction or an upwards direction, which jerks are therefore damped by the damped suspension device; at the same time, as the support column has a suitable inclined axis, even the impacts to which the boat is subjected, acting in a horizontal direction, induced by the mass of the wave which opposes the advancement of the boat, are unloaded on the support plane, causing the sliding thereof along the column, which movement is also damped by the damped suspension device.

A further aim of the invention is to realise a support apparatus for stretchers that is able to make the loading and unloading of the stretcher on the support plane easier, in consideration of the fact that the space internally of the sick bay is relatively narrow.

The invention is described in detail in the following with the aid of the accompanying figures of the drawings, which illustrate an embodiment thereof by way of non-exclusive example.

Figure 1:
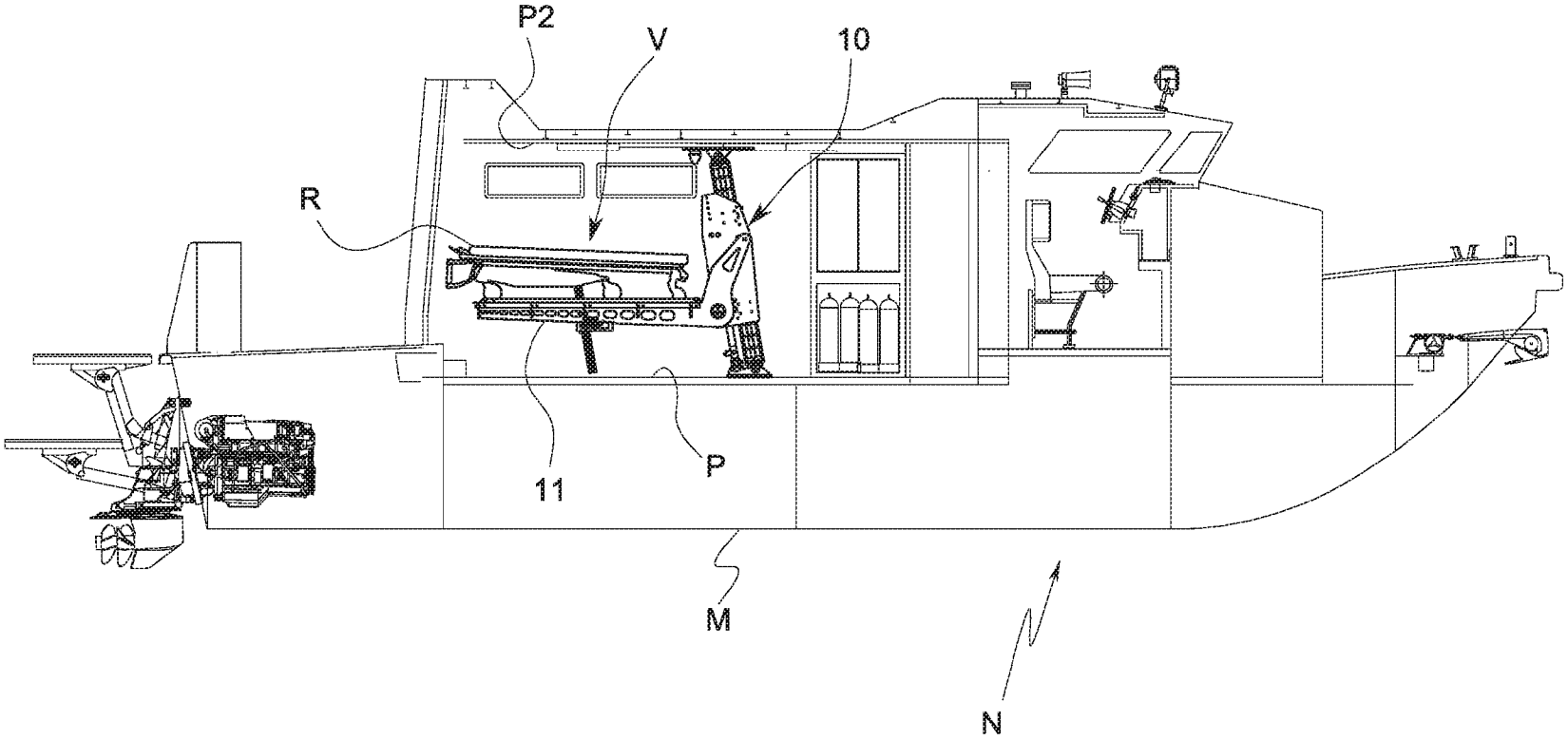
FIG. 1 is a vertical general view of the water ambulance, partly sectioned along the longitudinal vertical plane.

The rapid water ambulance for transport of patients, the injured and the like (denoted by letter N in FIG. 1), is a boat comprising a sick bay V solidly constrained to a structure of the water ambulance (in particular fixed to the hull M) internally of which a support apparatus (10) for a stretcher is arranged.

The support apparatus 10 comprises:

- a support column 20, constrained to the sick bay with a fixed axis with respect to the compartment,
- a carriage 30, constrained to the column 20, freely slidable along the column 20 in the direction of the axis A thereof,
- a support plane 11 for a stretcher, borne projectingly by the carriage 30 and solidly constrained thereto,
- a damped suspension device 33, constrained to the carriage 30 and to the column 20, which supports the support plane 11 at an operating height, supporting the weight placed thereon, and able to damp impacts acting on the support plane 11 caused by the motion of the water ambulance on waves.

The axis A of the support column 20 is inclined with respect to the perpendicular direction to the floor plane P of the sick bay and lies in the vertical plane parallel to the motion direction of the water ambulance.

In particular, in the embodiment illustrated in the figures, the axis A of the support column 20 is inclined with respect to a perpendicular direction to the floor plane P of the sick bay with an inclination directed upwards and towards the stern of the water ambulance.

The angle of inclination B that the axis A forms with respect to the perpendicular direction to the floor plane of the sick bay is comprised between 1 and 30 degrees, preferably between 5 and 20 degrees.

In detail, the support column 20 is hinged-constrained with an upper bracket 21 which is fixed (for example by means of bolts) to holes afforded in the upper horizontal panel P2, which defines the ceiling (upper base) of the sick bay V, and is hinge-constrained with a lower bracket 22, which is fixed (for example by means of bolts) to holes afforded in the lower horizontal panel, which defines the floor P of the sick bay V.

Additional holes are preferably included on the ceiling P2 (and/or on the floor P) for the fixing bolts of the brackets, so as to enable varying the angle of inclination B of the column 20, in able to better adapt to the angle of impact of the boat during the movement thereof, which can vary between one boat and another.

The support plane 11 is constrained to the support column 20 rotatably about the axis A of the column.

In detail, in the embodiment illustrated in the figures, the support plane 11 comprises a frame having two horizontal longitudinal members 12, parallel to one another, which support a horizontal panel 13 having a longitudinal extension which defines the rest plane of a stretcher R (illustrated in FIG. 1) or of another type of stretcher, or directly of the patient's body. The front end of the longitudinal members 12 is solidly constrained to the carriage 30.

The carriage 30 comprises two parallel vertical flanks 31, constrained to one another rigidly and located adjacent to two opposite lateral flanks of the column 20.

The column 20 has a substantially square section and has, on the lateral flanks, longitudinal guides 23 which substantially involve the whole length of the column.

The carriage 30 comprises guide skates 32, fixed to the flanks 31, which engage with the guides 23 of the column 20 and constrain the carriage 30 to translate along the axis A of the column 20.

The longitudinal members 12 have extensions, at the front end, which define a same number of arms 14, with which they are constrained to the carriage 30 by means of respective extensions, fixed to the front ends of the longitudinal members themselves, with which they form an angle. The arms 14 are constrained to the flanks 31 with the possibility of varying the angle of inclination of the support plane 11, so that it is possible to maintain the support plane 11 in a substantially horizontal position on varying the inclination of the column 20.

The support plane 11 then moves translatingly in a parallel direction to the axis A of the column 20, together with the carriage 30.

The weight of the support plane 11 and the load bearing on it is supported by a suspension device 33 having a jack 34 arranged parallel and adjacent to the column 20, having an upper end constrained to the carriage 30 and the lower end constrained to the lower bracket 22.

The hydraulic jack 34 is connected to a diaphragm accumulator loaded with nitrogen, where a hydraulic pump pumps oil into the circuit that joins the jack 34 and the accumulator; initially the oil compresses the gas internally of the accumulator by thus raising the pressure up to reaching the value required for the jack to raise the weight that acts on the support plane 11; on reaching the predefined height for the initial spring force, the pump stops and the system remains suspended by the pressure internally of the accumulator. A damper 35 is coupled to the jack 34 which damper 35 carries out the control of the oscillations by means of a choke valve 36 able to vary the choke in few thousandths of a second, so as to better control the reduction of accelerations. The valve is piloted by an electronic control unit which receives input from accelerometers and sensors in motion.

In this way the action of suspension actuated by the device 33 is of a self-adjusting hydro-pneumatic type on the basis of the patient's weight, with the maximum of reduction of accelerations for each weight transported.

The inclination of the column 20 with respect to the perpendicular direction to the floor plane P is included so that the column itself is also inclined with respect to the advancement direction on the water during the movements of the boat when transporting patients or injured parties. With this inclination, not only the vertical thrust of the weight beating on the support plane 11 by gravity is unloaded on the suspension device 33, but also the impacts in a horizontal direction to which the boat is subjected by the waves are partially damped by the suspension device 33, as the horizontal component determined by the inclination B of the column 20 is damped.

The support plane 11 can assume different height positions, in particular a lower position for enabling the loading of the stretcher on it, and a more appropriate position during the motion of the boat. The height adjustment of the plane 11 is made using the jack 34.

Further, the support plane 11 can rotate about the axis A of the column 20, between the position for transport of the patient during the motion of the water ambulance, and a loading position of the stretcher on the support plane 11.

Figure 2:
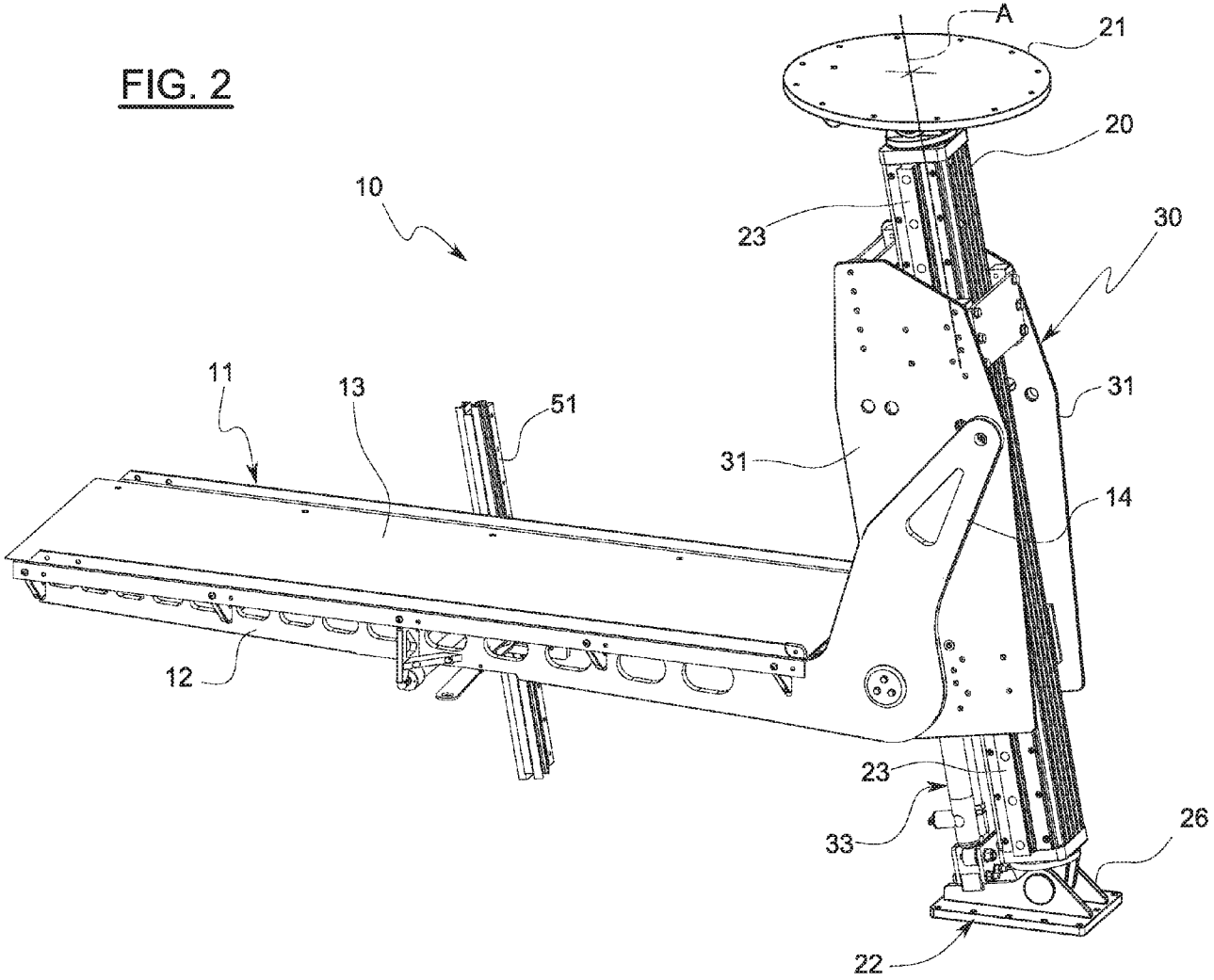
FIG. 2 is a perspective view of the support apparatus located in the sick bay.
Figure 2A:
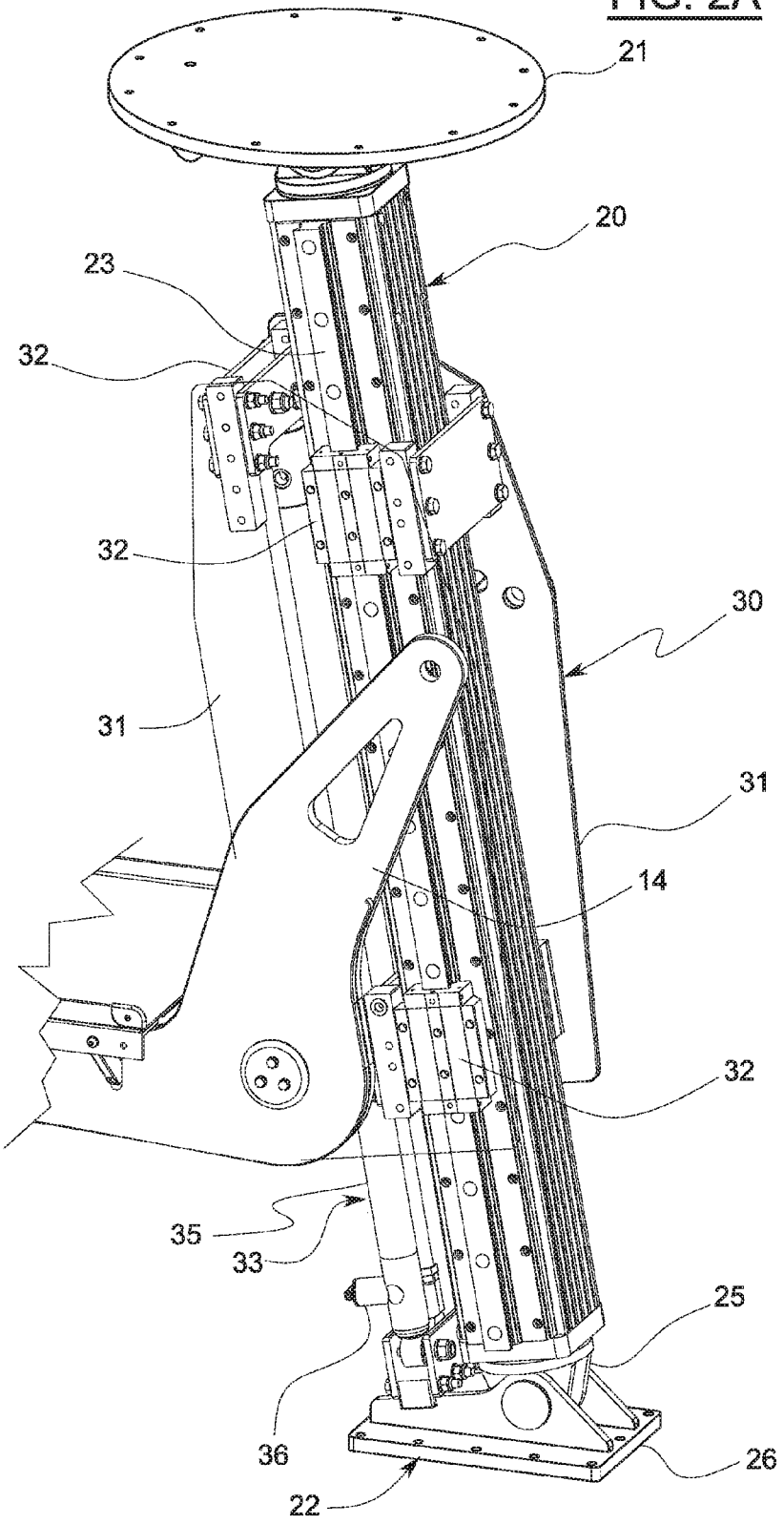
FIG. 2A is a larger-scale detail of FIG. 2.
Figure 2B:
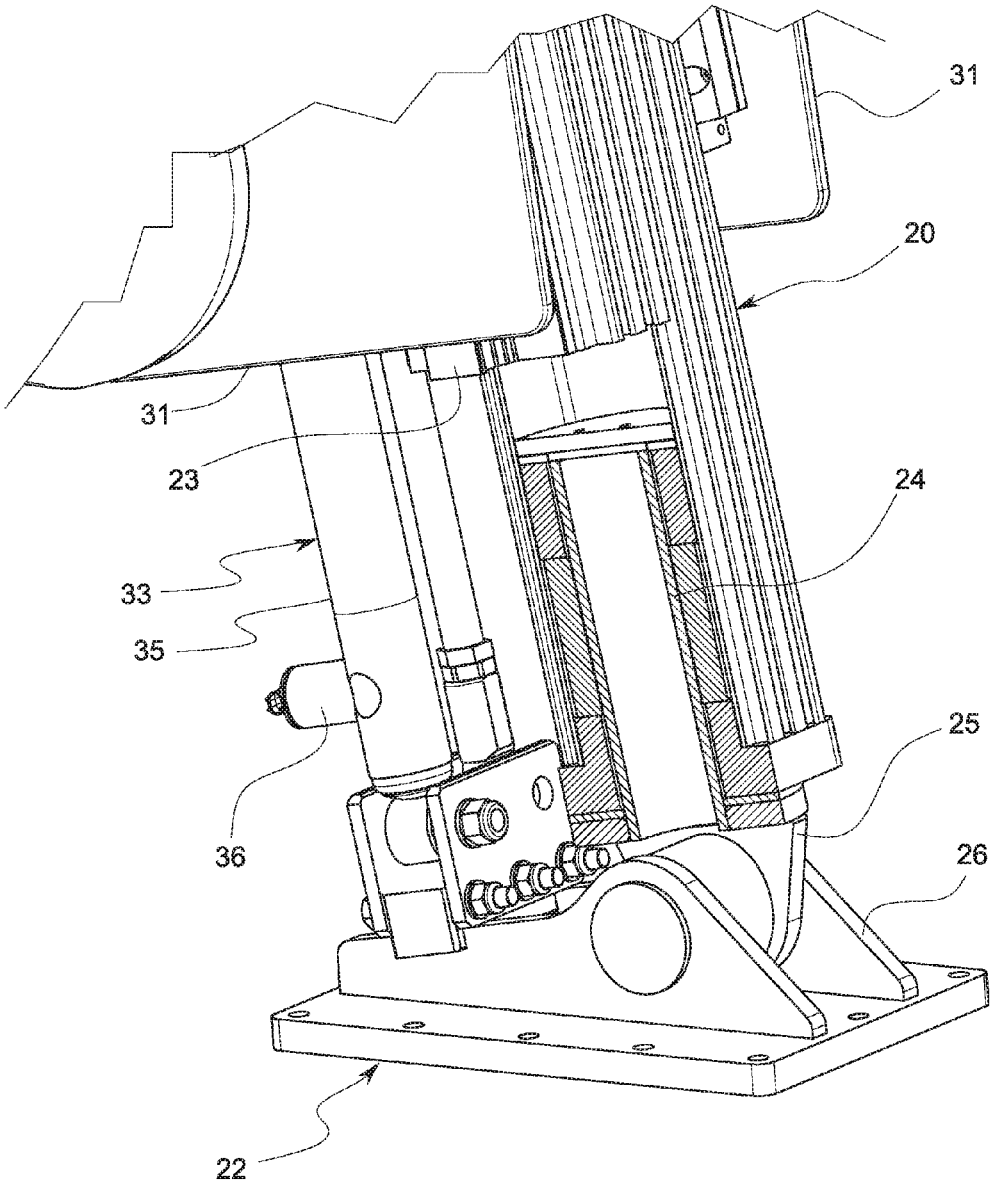
FIG. 2B is a larger-scale detail of FIG. 2A.
Figure 3:
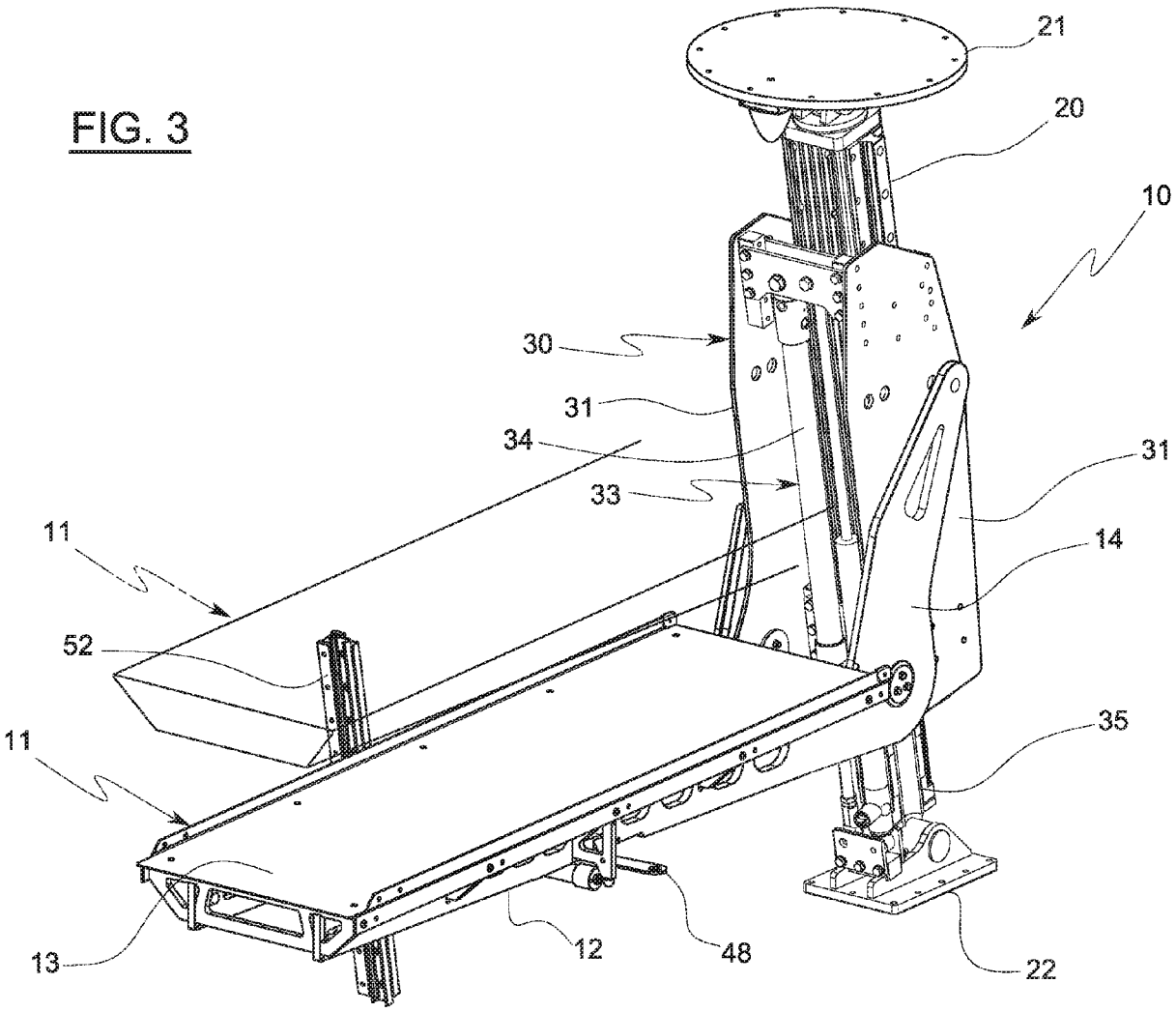
FIG. 3 is a second perspective view, seen from a different angle, of the support apparatus of FIG. 2.
Figure 4:
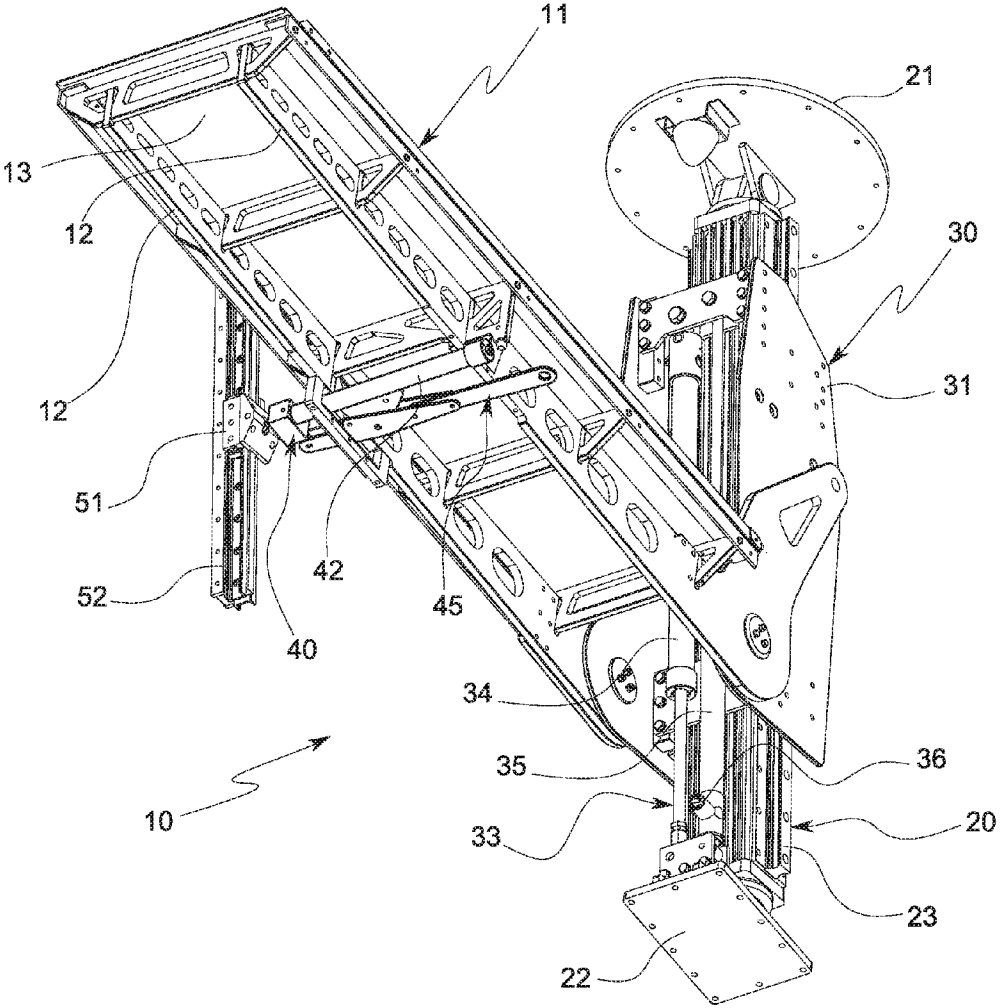
FIG. 4 is a perspective view of the apparatus of FIG. 2, seen from a different angle located inferiorly of the support plane of the apparatus.

For this purpose, in the embodiment illustrated in the figures, the column 20 is constrained to the sick bay V rotatably about the axis A of the column. In detail (see FIG. 2B), each of the two ends, upper and lower, of the column 20 is coupled to an axial tubular pin 25, fixed to the bracket 21, or respectively 22; more precisely, the pin 24 is fixed to a bracket element 25, which is in turn hinged with the part 26 of bracket that is fixed to the panel P2 of the sick bay or respectively to the floor P.

In the use of the water ambulance, thanks to the possibility that the support plane 11 has of rotating about the axis A of the column 20, it is advantageous to rotate the plane so as to arrange it in a first position (denoted by 11A in FIG. 1*b*) in which the rear end thereof is in the median position in the sick bay V, where the access door T to the cabin V is located, so that it is possible to comfortably load and vice versa unload even large stretchers (for example of the road-use type) onto/from the plane. Thereafter it is advantageous to return the support plane 11 into a second position (denoted by 11B in FIG. 1*b*) adjacent or in any case parallel to the lateral wall of the sick bay, so as to free and make accessible passage of persons or objects through the door T of the sick bay V and further arrange, during motion, the patient parallel to the movement direction of the boat.

Figure 1A:
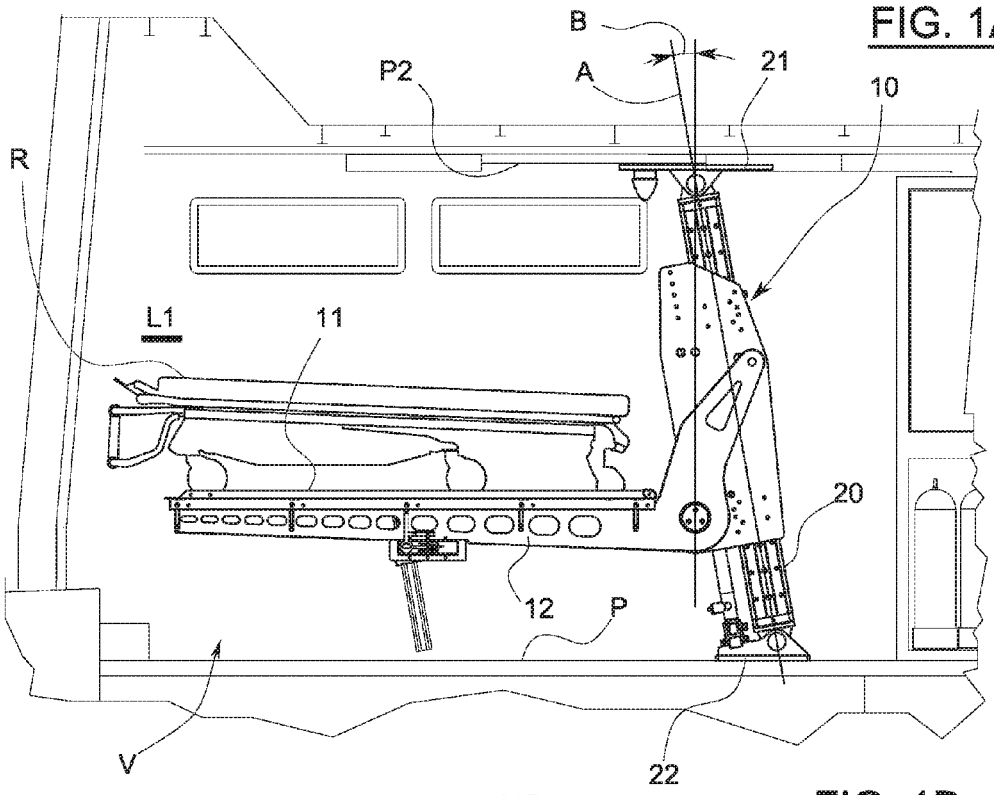
FIG. 1A is a lateral view of the sick bay and the support apparatus for a stretcher, arranged in the sick bay.
Figure 1B:
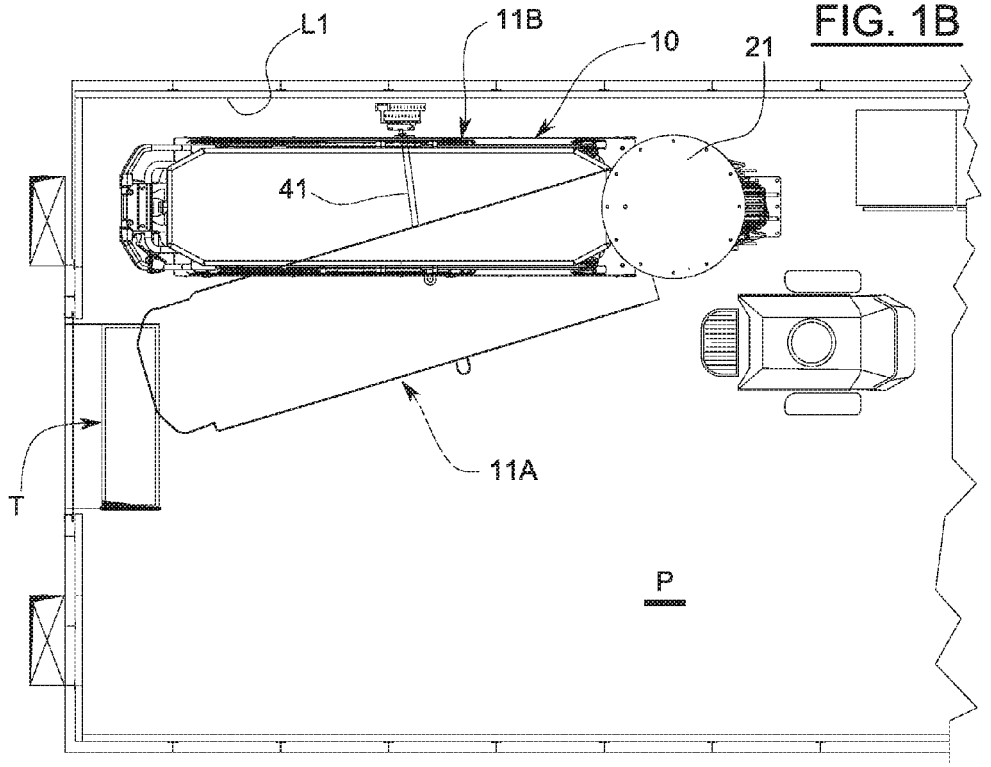
FIG. 1B is a plan view from above of FIG. 1A.

In FIGS. 1, 1A and 1B, the support apparatus 10 is arranged with the support plane 11 projecting from the column 2 facing towards the stern end of the boat, as in this case the access T to the sick bay V is located in the stern of the boat.

Figure 6:
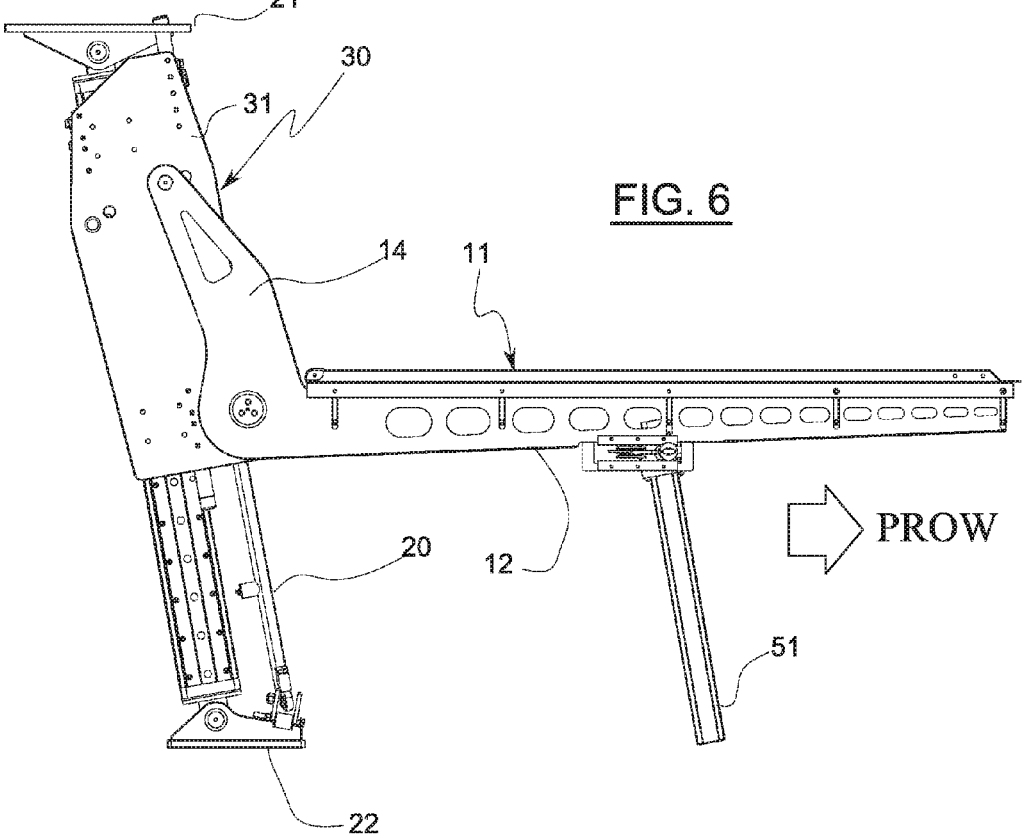
FIG. 6 is a different configuration of the support apparatus for a stretcher with respect to FIG. 1.

In FIG. 6, on the other hand, the support apparatus 10 is arranged with the support plane 11 projecting from the column 2 facing towards the prow end of the boat, as in this case the access T to the sick bay V is located in the prow of the boat; once more the aim is to enable the plane 11 to be arranged at the access T, in loading/unloading the stretcher R.

The column 20, on the other hand, is always at the same inclination, directed upwards and towards the stern of the boat.

It is possible to pass from one configuration to another, simply by rotating the plane 11 by 180 degrees with respect to the column 20 and by varying the angle with which the arms 14 are constrained to the flanks 31.

The water ambulance further comprises a telescopic arm 40 which constrains the support plane 11 to the sick bay V, especially so as to make the position thereof stable in the presence of lateral stresses (when the boat rolls).

The arm 40 comprises a stem 41 that is slidable and de-insertable in and out of a tubular member 42.

A first end of the arm 40 (external end 41*a* of the stem 41) is constrained to a lateral wall L1 of the sick bay V and the second end (opposite end 42*a* of the tubular member 42) is constrained to the support plane 11.

The arm 40 is telescopic and extends or shortens, enabling the support plane 11 to rotate about the axis A of the column from the first position 11A to the second position 11B and vice versa.

The arm 40 comprises a device 45 for blocking a length of the arm in two end positions, extracted and retracted, to which correspond the first position 11A and respectively the second position 11B of the support plane 11.

Figure 5:
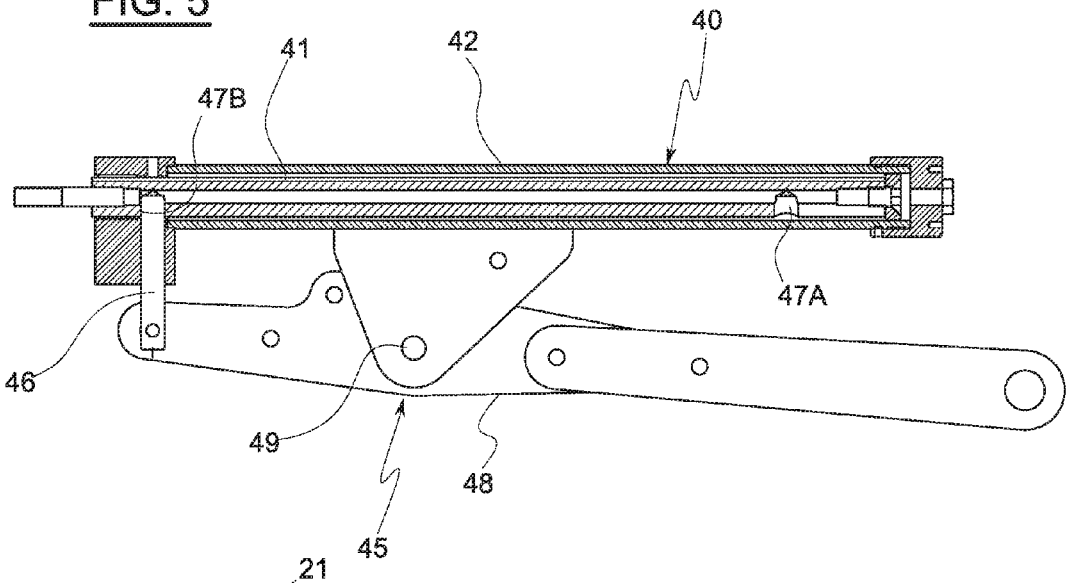
FIG. 5 is a section view of the anti-rotation constraining arm of the support plane.

In the embodiment illustrated in FIG. 5, the blocking device 45 comprises a pawl 46 able to penetrate, with a transversal movement, into the tubular member 42 up to occupying one or the other of two seatings 47A or respectively 47B fashioned on the lateral surface of the stem 41.

The pawl 46 is located at the end 42*b* of the tubular member 42 where the stem 41 exits; when the pawl is inserted in the seating 47A the stem 41 is blocked in the extracted position to which the first position 11A of the support plane 11 corresponds; when the pawl is instead inserted in the seating 47B the stem 40 is blocked in the extracted position (as illustrated in FIG. 5) to which the second position 11B of the support plane 11 corresponds.

To activate the pawl 46, or for inserting and extracting it to/from the seatings of the stem 41, a lever 48 is included, pivoted at the position denoted by 49 to a bracket solidly constrained to the tubular member 42, easily grippable and activatable manually by an operator.

The end 41*a* of the stem 41 is constrained, by a hinge, to a skate 51 that is slidable along a vertical guide 52 which is applied to the lateral wall L1 of the sick bay; the coupling between the skate 51 and the guide 52 constrains the skate in the perpendicular direction to the wall of the sick bay and enables movement of the guide in a vertical direction; thus a constraint is made which enables the arm 40 to follow the support plane 11 along the whole possible vertical run.

LIST OF ALPHA-NUMERICAL REFERENCES USED IN THE FIGURES

A Axis of column 20
B Angle between the axis A and the vertical
N Boat
V Sick bay
M Hull
P Floor plan
P2 Upper panel-ceiling
L1 Lateral wall
T Access door to the sick bay V
R Stretcher
10 Support equipment
11 Support bench
11A First position of 11
11B Second position of 11
12 Longitudinal members
13 Rest panels
14 arms
20 Support column
21 Upper bracket
22 Lower bracket
23 Guides
24 Tubular pin
25 Mobile bracket element 21/22
26 Fixed bracket element 21/22
30 Carriage
31 Flanks
32 Guide skates
33 Suspending device
34 Jack
35 Damper
36 Accumulator choke valve
40 Telescopic arm
41 Stem
42 Tubular member
45 Blocking device
46 Pawl
47A-47B Seatings
48 Lever
49 Pin
51 Skate
52 Guide

The invention claimed is:

1. A rapid water ambulance for transport of patients or injured, comprising a sick bay solidly constrained to a structure of the water ambulance and a support apparatus (10) for a stretcher, arranged in the water ambulance, wherein the support apparatus (10) comprises:

a support column (20), constrained to the sick bay with a fixed axis (A) with respect to the sick bay, a carriage (30), constrained to the column (20), freely slidable along the column (20) in the direction of the axis (A) thereof, a support plane (11) for a stretcher, borne projectingly by the carriage (30) and solidly constrained thereto, a damped suspension device (33), constrained to the carriage (30) and to the column (20), which supports the support plane (11) at an operating height, supporting the weight placed thereon and able to damp impacts acting on the support plane (11) caused by the motion of the water ambulance on waves, wherein the axis (A) of the support column (20) is inclined with respect to the perpendicular direction to the floor plane (P) of the sick bay and lies in the vertical plane parallel to the motion direction of the water ambulance.

2. The water ambulance of claim 1, wherein the axis (A) of the support column (20) is inclined with respect to a perpendicular direction to the floor plane (P) of the sick bay with an inclination directed upwards and towards the stern of the water ambulance.

3. The water ambulance of claim 1, wherein the angle that the support column (20) forms with respect to the perpendicular direction to the floor plane (P) of the sick bay is between 1 and 70 degrees.

4. The water ambulance of claim 1, wherein the support plane (11) is constrained to the support column (20) with a possibility of rotation about the axis (A) of the column, and further comprises means for enabling rotation of the support plane (11) about the axis (A) of the column (20), between a position (11B) for transport of the patient during the motion of the water ambulance, and a loading position (11A) of the stretcher on the support plane (11).

5. The water ambulance of claim 4, further comprising a telescopic arm (40) which constrains the support plane (11) to the sick bay (V), enabling the support plane (11) to rotate about the axis (A) of the column from the first position (11A) to the second position (11B) and vice versa.

6. The water ambulance of claim 5, wherein the arm (40) comprises a device (45) for blocking a length of the arm (40) in two end positions, to which correspond the first position (11A) and respectively the second position (11B) of the support plane (11).

7. The water ambulance of claim 3, wherein the angle that the support column (20) forms with respect to the perpendicular direction to the floor plane (P) of the sick bay is between 3 and 15 degrees.

* * * * *